US006374527B1

(12) United States Patent
Finardi

(10) Patent No.: US 6,374,527 B1
(45) Date of Patent: Apr. 23, 2002

(54) SAFETY DEVICE FOR PREVENTING UNAUTHORIZED USE OF A FIRE-ARM

(76) Inventor: Ivo Finardi, Viale Sempione 21/31, 1-20020 Arese MI (IT)

( * ) Notice: Subject to any disclaimer, the term of this patent is extended or adjusted under 35 U.S.C. 154(b) by 0 days.

(21) Appl. No.: 09/541,611

(22) Filed: Apr. 3, 2000

(30) Foreign Application Priority Data

Apr. 2, 1999 (IT) ..... TO99 A 0257

(51) Int. Cl.[7] ..... F41A 17/00
(52) U.S. Cl. ..... 42/70.11
(58) Field of Search ..... 42/70.01, 70.11

(56) References Cited

U.S. PATENT DOCUMENTS

| | | | | | |
|---|---|---|---|---|---|
| 2,327,334 | A | * | 8/1943 | Parker | 42/1 |
| 2,479,107 | A | * | 8/1949 | Garretson | 42/70 |
| 2,887,807 | A | | 5/1959 | Santangelo | 42/1 |
| 4,266,356 | A | | 5/1981 | Järvinen | 42/1 |
| 4,398,366 | A | * | 8/1983 | Wernicki | 42/1 LP |
| 4,512,099 | A | * | 4/1985 | Mathew | 42/1 LP |
| 5,171,924 | A | | 12/1992 | Honey et al. | 42/70.11 |
| 5,241,770 | A | | 9/1993 | Lambert | 42/70.11 |
| 5,398,438 | A | | 3/1995 | Williams | 42/70.11 |
| 5,664,358 | A | | 9/1997 | Haber et al. | 42/70.11 |
| 5,699,687 | A | * | 12/1997 | Pittman | 70/376 |
| 6,311,422 | B1 | * | 11/2001 | Exum et al. | 42/70.11 |

FOREIGN PATENT DOCUMENTS

IT 001089 12/1997

* cited by examiner

*Primary Examiner*—Charles T. Jordan
*Assistant Examiner*—Kimberly S. Smith
(74) *Attorney, Agent, or Firm*—Young & Thompson

(57) ABSTRACT

A safety device of the kind which comprises a body intended to be inserted into the barrel of a fire-arm and having a rotatable latch eccentrically mounted at its rear end portion and suitable for keeping an inactive position, in which it does not project out of the periphery of the body and therefore does not hinder the insertion of the body into the fire-arm barrel, and an active position in which a portion of the latch projects with respect to the periphery of the body and engages a recess of the fire-arm barrel, thus blocking the body relative to the fire-arm barrel, and a transmission member connected to the rotatable latch and to a lock mounted within the forward end portion of the body, this lock being operable by means of a proper key in order to rotate the latch through the transmission member. According to the invention, the safety device further comprises a slider, guided by the device body in order to be displaceable along a diametrical direction, and to the rotatable latch is coupled in rotation a cam engaging the slider in order to displace the same, by action of the rotation of the transmission member, between an inactive position, in which the slider is included within the periphery of the device body, and an active position, in which a portion of the slider projects out of the device body at the side opposite the side wherein, in its active position, projects the rotatable latch, both the rotatable latch and the slider being thus moved to their respective active or inactive positions by the same rotation of the transmission member.

13 Claims, 4 Drawing Sheets

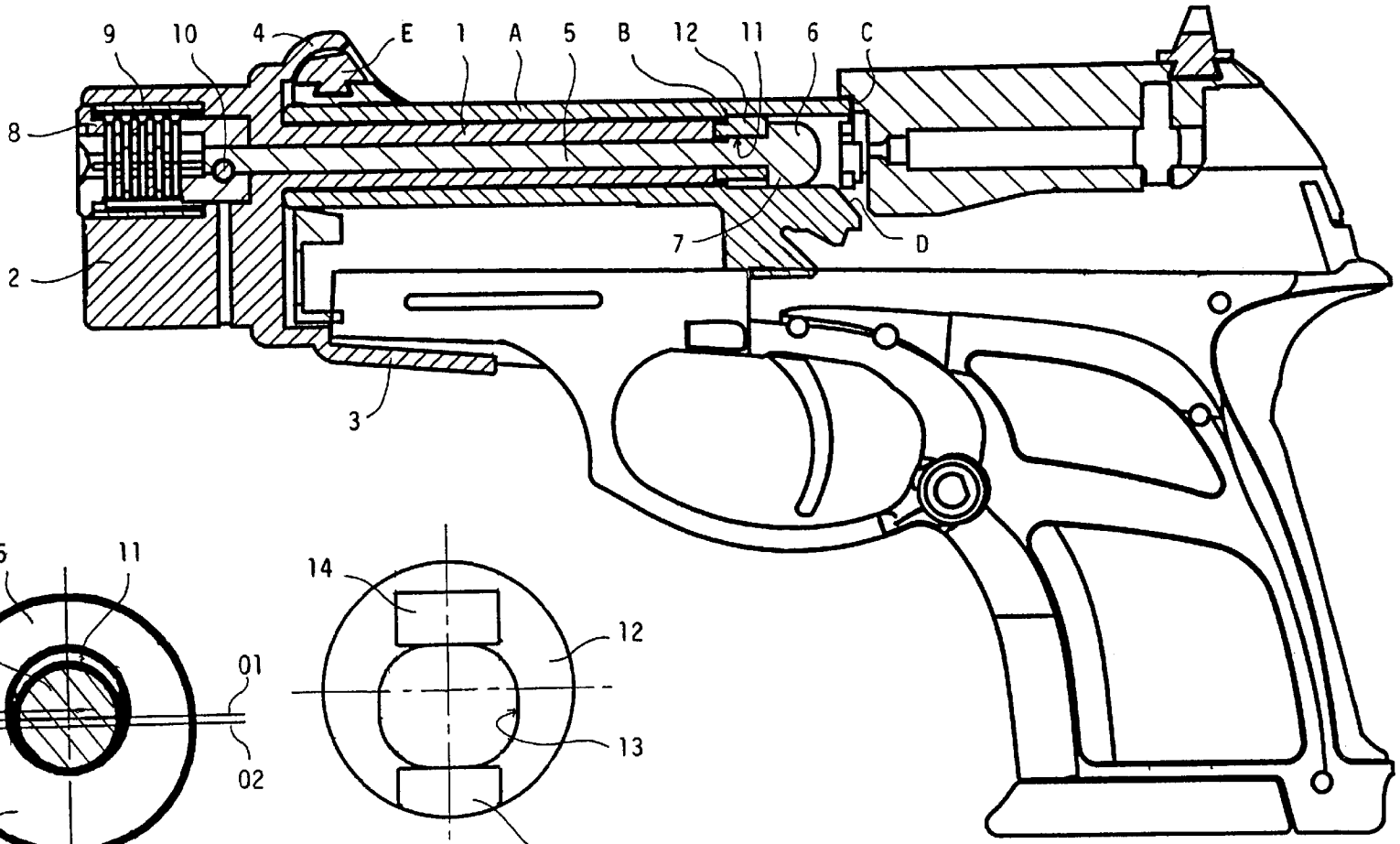
FIG. 1
FIG. 7
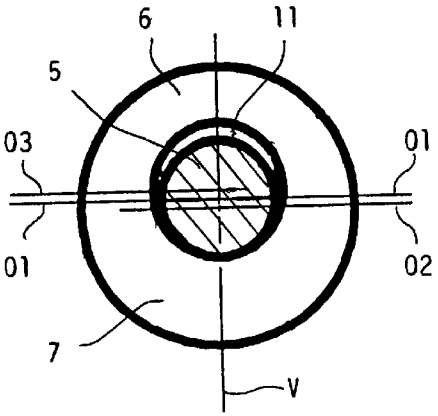
FIG. 6

SAFETY DEVICE FOR PREVENTING UNAUTHORIZED USE OF A FIRE-ARM

BACKGROUND OF THE INVENTION

This invention refers to a safety device intended to prevent the unauthorized use of a fire-arm of the kind whose barrel has at least one recess in at least one location of its inner surface. At least one recess is present in most of the modern fire-arm barrels.

The potential danger represented by fire-arms which can be improperly used by unauthorized persons has suggested to provide safety devices having a lock, which can be mounted onto the fire-arm in such a manner as to prevent the operation thereof until the safety device has been removed by a person provided with the proper key corresponding to the lock of the safety device.

On the basis of this principle, there have been proposed some safety devices which can be mounted in the region of the trigger of the fire-arm in such a way as to prevent its operation. However these safety devices have not been deemed satisfactory, mainly in that they can easily be inoperative when imperfectly mounted. Moreover, the thus protected fire-arm can still be operated by using sagacious contrivances. Finally, these safety devices cannot surely prevent the shot of a projectile which was already in shot position within the barrel when the safety device has been mounted onto the fire-arm. In effect nothing prevents such a safety device to be installed, voluntarily or by inadvertence, on a fire-arm whose projectile is in the shot position.

There has also been proposed a safety device which comprises a false cartridge-case extended by a steel cable which can receive the application of a padlock. The false cartridge-case is inserted into the barrel of the fire-arm from the rearward end thereof, with the steel cable extending along the barrel and projecting from the forward end thereof, and this cable is then blocked by means of the padlock. Such a device ensures a complete safety, but it has the heavy drawback that, when the fire-arm should be put again in condition of use, a complicated maneuver and a noticeable delay are needed for removing the false cartridge-case after opening of the padlock. This can jeopardize a timely intervention by the use of the fire-arm in urgent cases.

There have also been proposed safety devices in which a shaft introduced into the barrel of a fire-arm is provided of some members which can be made to expand against the inner surface of the barrel, and then blocked by means of a lock in this expanded position. The thus expanded members normally prevent removing the shaft from the barrel, but they act only by friction, whereby the application of a force strong enough allows to violate the safety device. Moreover, the mechanisms of such safety devices are excessively complicated and weak.

Finally, there have been proposed safety devices intended to prevent the unauthorized use of a fire-arm of the kind whose barrel has a recess in a location of its inner surface; more precisely, such devices are destined to be mounted onto a revolver. These safety devices include a body intended to be inserted into the fire-arm barrel and provided with a rotatable latch eccentrically mounted on the rear end portion of the body. The rotatable latch is suitable for keeping an inactive position, in which it does not project out of the periphery of the body and therefore it does not hinder the insertion of the body into the fire-arm barrel, and an active position in which a portion of the latch a projects with respect to the periphery of the body and engages the recess of the fire-arm barrel, thus blocking the body relative to the fire-arm barrel. A transmission member is connected to the rotatable latch and to a lock mounted within the forward end portion of the body, this lock being operable by means of a proper key in order to rotate the latch through the transmission member between its inactive and active positions.

Such a safety device cannot be installed when a projectile is in the shot position, whereby, if such projectile is present, it should be removed in order that the safety device can be installed. After the device is installed with the latch in inactive position, by operating the lock and removing its key the latch is rotated in its active position, it engages the recess of the fire-arm barrel and prevents the removal of the safety device until the latch has been moved again to its inactive position by operating the lock by means of the proper key.

In theory, this known safety device solves the safety problem, and in some applications, such as with revolvers, it is satisfactory also in the practice, but it is not effective in other applications. In several cases, and mainly in the automatic pistols, unlike the revolvers, the recess present in the fire-arm barrel has a very limited depth, whereby it is not possible to ensure an effective engagement of the latch by keeping into account the different tolerances of manufacture, the clearance needed for inserting the device body into the fire-arm barrel and also, in certain cases, the conicity of the barrel mouth, foreseen in order to facilitate the entrance therein of the cartridge. Even when the engagement is attained, it is somewhat failing because, under a force strong enough, some parts can be disformed and then allow removing the safety device.

SUMMARY OF THE INVENTION

In view of the foregoing, the main object of the present invention is to provide a safety device with a lock, intended to be applied to a fire-arm of the kind whose barrel has at least one recess in at least one location of its inner surface, in order to prevent its unauthorized use, which device should offer a complete safety even against strong actions, and which should require only a very simple, quick and easy maneuver for putting the fire-arm in condition of use by a person which has the proper key corresponding to the device lock.

Another object of the invention is to provide such a safety device which cannot be incorrectly mounted so as to elude its function.

Still another object of the invention is to provide such a safety device which can be industrially manufactured in a convenient way and at a reasonable cost.

The safety device of the invention is of the kind which comprises a device body intended to be inserted into the barrel of a fire-arm and having a rotatable latch eccentrically mounted at the rear end portion of the device body and suitable for keeping an inactive position, in which it does not project out of the periphery of the body and therefore does not hinder the insertion of the device body into the fire-arm barrel, and an active position in which a portion of the latch projects with respect to the periphery of the device body and engages a recess of the fire-arm barrel, thus blocking the device body relative to the fire-arm barrel, and a transmission member connected to the rotatable latch and to a lock mounted within the forward end portion of the device body, this lock being operable by means of a proper key in order to rotate the latch through the transmission member.

According to the invention, a safety device of this kind further comprises a slider, guided by the device body in order to be displaceable along a diametrical direction with respect to the device axis, and to the rotatable latch is coupled in rotation a cam engaging said slider in order to displace the same, by action of the rotation of said transmission member, between an inactive position, in which the slider is included within the periphery of the device body, and an active position, in which a portion of the slider projects out of the device body at the side opposite the side wherein, in its active position, projects a portion of the rotatable latch, both the rotatable latch and the slider being thus moved to their respective active or inactive positions by the same rotation of the transmission member.

Within the frame of this main feature, the parts of the safety device can be designed in different manners.

In a first manner, the diametrically displaceable slider is intended to engage, in its active position, a recess of the fire-arm barrel, whilst the rotatable latch rests, in its active position, against the opposite wall of the barrel.

In a second manner, the rotatable latch is intended to engage, in its active position, a recess of the fire-arm barrel, whilst the displaceable slider rests, in its active position, against the opposite wall of the barrel.

In a third manner, both the rotatable latch and the diametrically displaceable slider are intended to engage, in their respective active positions, each a recess of the fire-arm barrel.

Thanks to these features, the presence of two members which, in the active condition of the safety device, project from opposite sides of the device body, allows in any case to compensate for any clearance, irrespective of its origin, and excludes that the disformation under stress of some parts could allow the unauthorized removal of the safety device by suppressing the engagement of a projecting member with a recess of the fire-arm barrel. The safety device is thus able to withstand even very strong violation actions. On the other hand, the mechanisms used are of a great simplicity, and therefore the safety device is relatively inexpensive and very reliable.

Preferably, the device body comprises an outer skirt so shaped as to positively engage the outer end portion of the fire-arm in order to render the device body positively solid with the fire-arm when inserted thereon.

As it may be remarked, the invention can be applied only to fire-arms whose barrel has at least one recess in its inner surface, however this fact does not heavily limit the application of the invention, because that circumstances are verified in about all the modern fire-arms. The invention may find application in any kind of fire-arms, however its typical application is to the automatic pistols. For this reason, the following description will refer to said specific application.

BRIEF DESCRIPTION OF THE DRAWINGS

These and other features, objects and advantages of the subject of the present invention will appear more clearly from the following description of three embodiments, having the character of non-limiting examples, with reference to the appended drawings, wherein:

FIG. 1 shows, partially in section and with some parts removed, an automatic pistol equipped with the safety device according to a first embodiment of the invention, in the condition of activity;

FIG. 6 shows, in an axial view according to arrow VI in FIG. 2, and on an enlarged scale, the sole end portion of the transmission member with the rotatable latch;

FIG. 7 shows, in an axial view according to arrow VI in FIG. 2, and on an enlarged scale, the sole diametrically displaceable slider;

DESCRIPTION OF THE PREFERRED EMBODIMENTS

With reference to FIG. 1, there is diagrammatically shown the section of an automatic pistol, which represents the kind of fire-arms to which is mainly foreseen the application of the safety device according to the invention, although this device could also find application on fire-arms of different kinds. It will be remarked that the inner surface of barrel A of the shown pistol has different recesses, namely: a little annular recess B limited by the shoulder against which is intended to rest the cartridge-case of a projectile in the shot position (this recess B can however be lacking in other types of fire-arms), an annular recess C defined by the rear frontal face of barrel A, and an inclined recess D foreseen for facilitating entrance of a projectile in barrel A.

The device according to the invention needs for its application the presence of at least one recess in the inner surface of the fire-arm barrel, Any one of the cited recesses, or more than one of them, could be used in order to apply the safety device of the invention. In this description, for the first embodiment of the invention (FIGS. 1 to 7) recess B has been chosen, for the second described embodiment (FIGS. 8 to 12) recess D has been chosen, whereas for the third embodiment (FIG. 8, broken lines) both recesses B and D have been chosen. The other parts of the fire-arm have no interest with reference to the application of this invention and, therefore, they will not be described.

Figure 5:
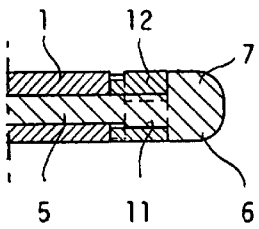
FIG. 5 shows a section of the sole rearward portion of the safety device according to FIG. 2, in the inactive condition.
Figure 4:
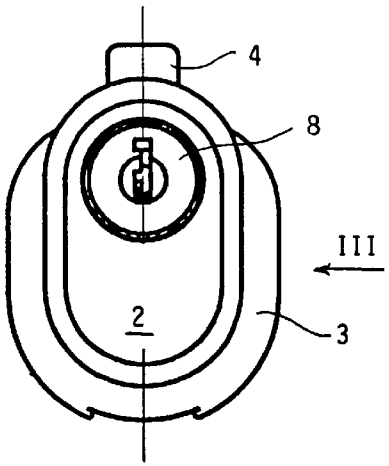
FIG. 4 is a view of the safety device of FIG. 2, seen from the forward end thereof according to arrow IV in FIG. 3.
Figure 2:
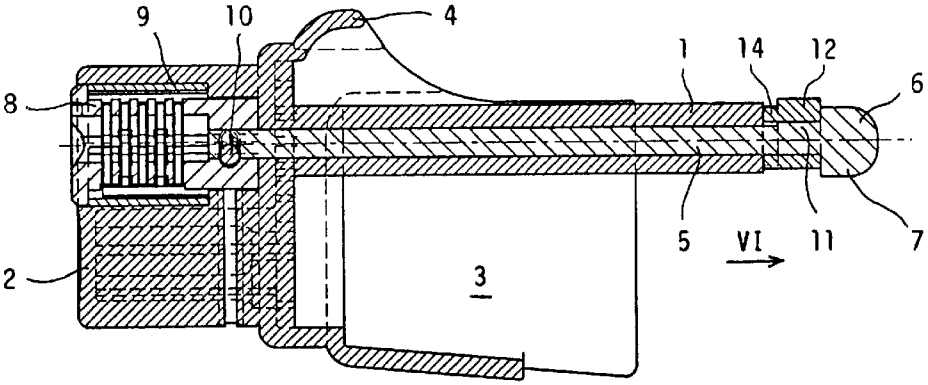
FIG. 2 shows the safety device of FIG. 1, isolated from the pistol, in the same condition of activity.
Figure 3:
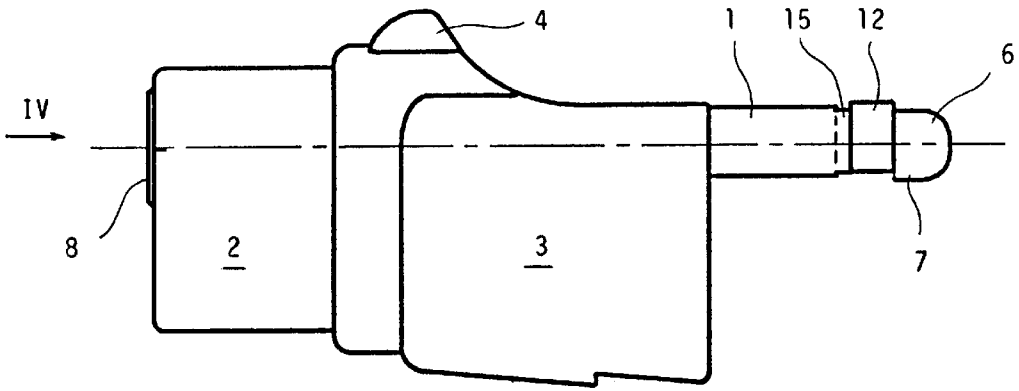
FIG. 3 is a side view of the safety device of FIG. 2, seen according to arrow III of FIG. 4.

The safety device according to the first exemplary embodiment of the invention is shown in longitudinal section, in different conditions, in FIGS. 1, 2 and 5, and in external views in FIGS. 3 and 4. The safety device comprises a device body 1 of elongated shape, suitable for being inserted into barrel A of the fire-arm and to extend with its rear end portion up to the region of recess B. The device body 1 is shaped in view that at least its rear end portion should be centered with respect to the axis of barrel A when the safety device is in position on the fire-arm. At its forward end portion, the device body 1 expands to form a lock body 2 suitable for housing a lock and, moreover, preferably it also has a skirt portion 3 intended to surround the forward end portion of the pistol and extending with a portion 4 suitable for engaging the foresight E of the fire-arm.

The device body 1 of the safety device is longitudinally traversed by a bore through which passes a shaft 5 forming a transmission member for the rotation. At least the rear end portion of shaft 5 is eccentric with respect to the rear end portion of body 1 and, therefore, also with respect to the rear end portion of barrel A. To this rear end portion of shaft 5 is connected a rotatable latch 6 having at least one asymmetrical portion 7. In the practice, the rotatable latch 6-7 can be circular and eccentric with respect to the axis of shaft 5. In the shown embodiment, the rotatable latch 6 and the shaft 5 are manufactured of a single piece. The rotatable latch 6-7 is designed in such a way that it can assume two operating positions with respect to the device body 1, namely: an inactive position (FIG. 5), wherein no portion of the rotatable latch 6-7 projects out of the periphery of the device body 1, and an active position sition (FIGS. 1 and 3), wherein on the contrary the asymmetrical portion 7 of latch 6-7 projects with respect to the periphery of the device body 1.

To the rotatable latch 6-7 and to the shaft 5 is solid in rotation a cam 11, which in the example shown is manufactured of one piece with shaft 5 and latch 6-7. Cam 11 has its eccentricity opposite the eccentricity of portion 7 of the rotatable latch 6-7. In more detail, referring to FIG. 6, the center of shaft 5 lies at the intersection of an axis V with a perpendicular axis O1, the center of the eccentric portion 7 of the rotatable latch 6-7 lies at the intersection of the same axis V with a perpendicular axis O2, and the center of cam 11 lies at the intersection of the same axis V with a perpendicular axis O3, which is displaced, placed, with respect to axis O1, opposite the axis O2.

Cam 11 engages an opening 13 of a slider 12 (FIG. 7), and the slider 12 is provided with projections 14 guided between side flanges 15 (FIG. 3) of the device body 1, whereby the slider 12 can displace only in a diametrical direction. Therefore, the rotation of shaft 5 with the cam 11 causes a diametrical displacement of slider 12.

Slider 12 is designed in such a way that it can assume two operating positions with respect to the device body 1, namely: an inactive position (FIG. 5), wherein no portion of slider 12 projects out of the periphery of the device body 1, and an active position (FIGS. 1 and 3), wherein on the contrary a portion of slider 11 projects with respect to the periphery of the device body 1. Considering all the foregoing, in the active position the slider 11 and the asymmetrical portion 7 of latch 6-7 project with respect to the device body 1, from opposite sides of the device body 1.

In the now described embodiment of the invention, the measures of all the parts are so designed that in the active position (FIGS. 1 and 2) slider 12 engages the recess B of the fire-arm barrel A, whereas the rotatable latch 7 rests (at the opposite side) against the inner surface of the fire-arm barrel A. In these conditions, the device body 1 is rendered solid with the fire-arm in an extremely effective way, and the whole is suitable for withstanding even violation attempts effected with strong force. Thanks to the opposite rest of the rotatable latch 6-7 against the barrel surface, this blockage is very reliable notwithstanding the reduced depth of recess B wherein engages the slider 12.

On the contrary, in the inactive position (FIG. 3) both the rotatable latch 6-7 and the slider 12 do in no way project out of the periphery of the device body 1, whereby the safety device, when in its inactive position, may be easily inserted into the fire-arm barrel A or removed therefrom.

Within the lock portion 2 of the device body 1, intended to form or to contain a lock, according to this example there is inserted a hollow cylinder 9 wherein is rotatably housed a lock plug 8 which, co-operating with the lock body 2, forms a lock which includes, as usual, a number of locking pins and counter-pins pushed by springs. The lock plug 8 is connected in rotation with shaft 5 by means of an eccentric pin 10, which allows easily mounting the mechanism and is suitable for withstanding even strong forces. The rotation of lock plug 8 can be done by the proper key, and through shaft 5 it allows to displace both the rotatable latch 6-7 and the slider 12 from their inactive position to the active position and vice-versa.

Preferably, the lock mechanism is so designed that the key can be removed therefrom only when the safety device is in its active position. This feature, on one hand, prevents loss of the key, and on the other hand, above all, it prevents that the safety device be inserted by then forgetting to displace the device to its active position. In effect, in the case of such a mistake, it would not be possible to remove the key from the safety device.

It is to be remarked that the structure of this safety device is substantially simple, and it can be industrially manufactured without difficulties and in a relatively inexpensive way.

The operation of the safety device according to the invention, according to its first embodiment just described, is as follows:

Usually, when the safety device is inactive and is separated from a fire-arm, the key is retained within the lock plug 8. In this condition the safety device can be inserted into the barrel A of a fire-arm, provided however that no projectile is in the shot position in the barrel. Should a projectile be in the shot position, it is needed to previously remove the same. When the safety device has been inserted, by rotating the key the device is displaced to its active position according to FIGS. 1 and 2. Then the slider 12 engages recess B and, simultaneously, the projecting portion 7 of latch 6-7 comes to rest against the inner surface of the fire-arm barrel A, at the opposite side. This way the removal of the safety device is positively prevented and is thus prevented the use of the fire-arm too. In this active position of the safety device, the key may be removed.

In order to put the fire-arm again in use, the person provided with the proper key inserts the same into the lock plug 8 and rotates the key by 180°, thus displacing both the slider 12 and the rotatable latch 6-7 to their inactive positions according to FIG. 3. The safety device is then removed from the fire-arm barrel A, and the fire-arm is immediately found in condition of use. As it may be observed, this operation is extremely easy and brief, practically instantaneous.

Under the constructive point of view, the rotatable latch 6-7 should be eccentric, whereas the lock (which may comprise the lock plug 8 and the other component parts mentioned, or any other kind of lock) can be eccentric as the rotatable latch, as shown, and in this case the transmission member 5 extends along the device body 1 in a direction parallel to the device body axis, or even the lock could be centered, or eccentric on an extent different from the eccentricity of the rotatable latch 6-7, and in this case the transmission member 5 should extend along the device body 1 with a certain inclination with respect to the body axis.

The device body 1 should be made of a material not excessively hard, in order not to deteriorate the inner surface of the fire-arm barrel A. For example it may be manufactured of a suitable plastic material. The lock plug 8, the slider 12 and the rotatable latch 6-7 may be made of a metal having a suitable mechanical resistance.

According to the second embodiment of the invention, which is shown in FIGS. 8 to 12, the safety device is designed for using the recess D of the fire-arm barrel A, rather that the recess B, in order to block the safety device to the fire-arm. Therefore, in this embodiment, the safety device of the invention may be used even on fire-arms whose barrel does not have the recess B.

Most component parts of the safety device according to the second embodiment are identical to those described in connection with the first embodiment, apart from different measures of the device body and the shaft, and a different eccentricity of the shaft. The component parts are therefore de signed by the same reference numerals. The rotatable latch 6-7 is designed in order to engage, in its active position, the recess D of the fire-arm barrel A. Slider 12 is designed in order to rest, in its active position, against the inner surface of the fire-arm barrel A, opposite the recess D.

As it may be understood, the operation and use of the safety device according to this second embodiment are identical to those described in connection with the first embodiment. Also, all explications given in connection with the first embodiment are valid for this second embodiment too, by keeping into account the different proportions of the parts, which may be observed in particular from the comparation of FIGS. 11 and 12 with FIGS. 6 and 7.

Figure 8:
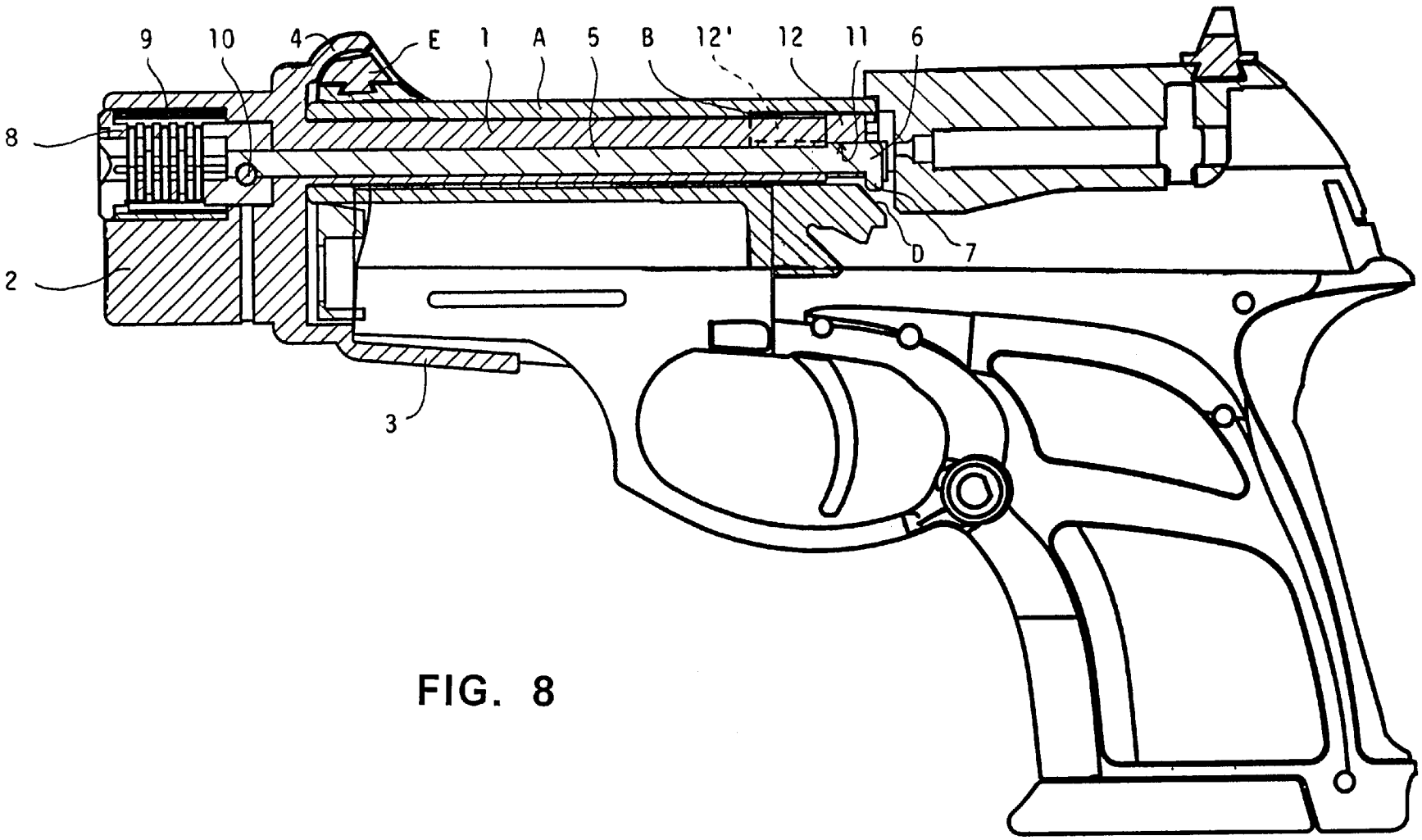
FIG. 8 shows, similarly to FIG. 1, a second embodiment of an automatic pistol equipped with the safety device of the invention, in the condition of activity, and also shows with broken lines the feature of a third embodiment bodiment of the invention.
Figure 10:
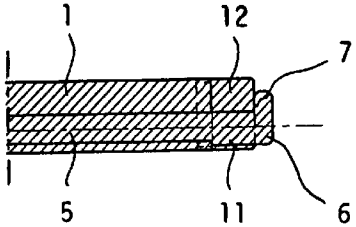
FIG. 10 shows a section of the sole rearward portion of the safety device according to FIG. 9, in the inactive condition.
Figure 9:
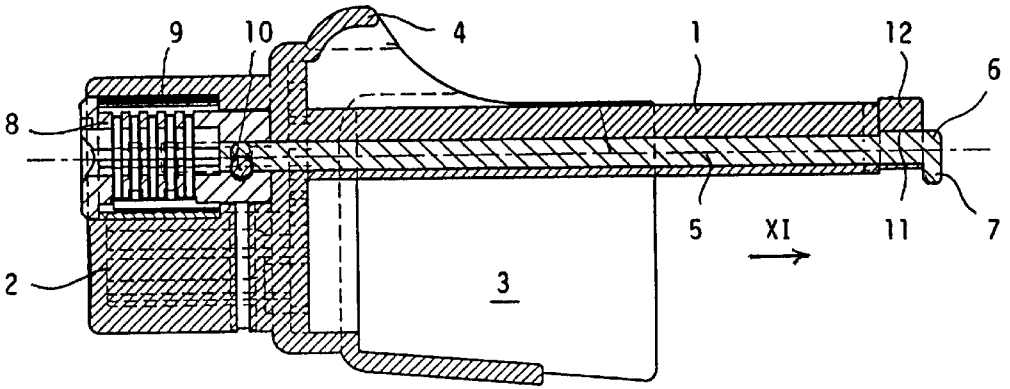
FIG. 9 shows the safety device of FIG. 8, isolated from the pistol, in the same condition of activity.
Figure 11:
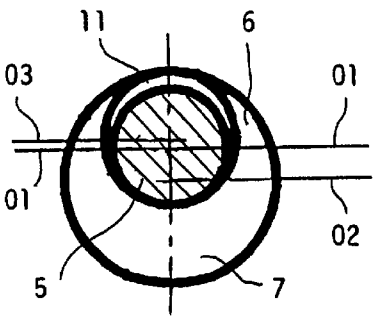
FIG. 11 shows, in an axial view according to arrow XI in FIG. 9, and on an enlarged scale, the sole end portion of the transmission member with the rotatable latch.
Figure 12:
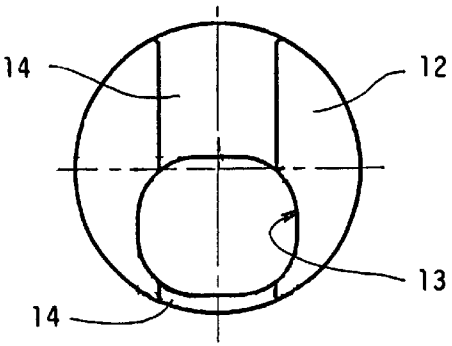
FIG. 12 shows, in an axial view according to arrow XI in FIG. 9, and on an enlarged scale, the sole diametrically displaceable slider.

Finally, FIG. 8 shows with broken lines how slider 12 could be displaced in the region 12', or be extended in such a way as to cover region 12' too. In this case, when the rotatable latch engages recess D of the fire-arm barrel A, the slider 12 does not simply rest against the opposite inner surface of the fire-arm barrel A, but it also engages recess B of barrel A. In this manner it has been defined a third embodiment of the invention, in which both the members acting in opposite directions, consisting in the rotatable latch 6-7 and the diametrically displaceable slider 12, simultaneously engage two different recesses (D and B, respectively) of the fire-arm barrel A.

From the given description of different embodiments of the invention one may understand that the invention may find application in connection with fire-arms having features even very different, by in any case choosing the more suitable embodiment of the invention.

It is to be realized that the invention is not limited to the embodiments described and shown by way of examples. Several modifications, in addition to those mentioned in the description, are within the ability of those skilled in the art. For example, the shapes of the rotatable latch and the diametrically displaceable slider could be modified in various manners; any kind of lock could be used, and this lock could also be arranged in a position different from that shown. The device body of the safety device may be shaped in order to completely fill the fire-arm barrel, as shown, or it could have in some portions thereof a more light construction.

These and other modifications, as well as any replacement by technically equivalent means, could be introduced in what has been described and shown, without departing from the scope of the invention as stated in the appended Claimed.

What is claimed is:

1. In a safety device intended to prevent the unauthorized use of a fire-arm having a barrel which has at least one recess in at least one location of its inner surface, the safety device comprising: a device body intended to be inserted into the barrel of the fire-arm, said device body having a forward end portion and a rear end portion; a rotatable latch eccentrically mounted at the rear end portion of said device body, said rotatable latch being suitable for keeping an inactive position, in which it is included within the periphery of said device body, and an active position in which a portion of said latch projects with respect to the periphery of said device body; a lock mounted within the forward end portion of said device body, said lock being operable by means of a proper key; and a transmission member connected to said rotatable latch and to said lock;

the improvement wherein the safety device further comprises: a slider, a guide means on said device body guiding said slider for displacement along a diametrical direction with respect to said device body, said slider being suitable for keeping an inactive position, in which it is included within the periphery of the device body, and an active position, in which a portion of the slider projects out of the device body at the side opposite the side wherein, in its active position, projects said rotatable latch; and a cam coupled in rotation to said rotatable latch and engaging said slider; at least one of said rotatable latch and said diametrically displaceable slider being arranged in a position corresponding to a recess of said fire-arm barrel and engaging said recess in its own active position;

whereby, by rotating said transmission member through said lock, both said rotatable latch and said slider can be moved to their respective active or inactive positions by the same rotation of said lock and transmission member.

2. A safety device as set forth in claim 1, wherein said diametrically displaceable slider engages in its active position a recess of said fire-arm barrel, whilst said rotatable latch rests against an opposite portion of the inner surface of said barrel.

3. A safety device as set forth in claim 1, wherein said rotatable latch engages in its active position a recess of said fire-arm barrel, whilst said diametrically displaceable slider rests against an opposite portion of the inner surface of said barrel.

4. A safety device as set forth in claim 1, wherein both said rotatable latch and said diametrically displaceable latch engage in their active positions each a recess of said fire-arm barrel.

5. A safety device as set forth in claim 1, wherein said rotatable latch and said cam are made of a single piece.

6. A safety device as set forth in claim 1, wherein said rotatable latch, said cam and said transmission member are made of a single piece.

7. A safety device as set forth in claim 1, wherein said lock comprises a lock plug, and the forward end portion of said device body houses said lock plug.

8. A safety device as set forth in claim 7, wherein said transmission member has the shape of a shaft, it is constructively separate from said lock plug, and the safety device includes an eccentric pin connecting said lock plug and said shaft.

9. A safety device as set forth in claim 1, wherein said lock is of a kind which does not allow removal of the key when the safety device is in its inactive position.

10. A safety device as set forth in claim 1, wherein the forward end portion of said device body has a skirt, said skirt being shaped in such a way as to positively engage the forward end portion of the fire-arm and to render said device body positively solid with the fire-arm when inserted thereon.

11. A safety device as set forth in claim 1, wherein said recess of the fire-arm barrel used for engagement of one of said diametrically displaceable slider and said rotatable latch is a recess forming a rest member for a cartridge-case of a projectile.

12. A safety device as set forth in claim 1, wherein said recess of the fire-arm barrel used for engagement of one of said diametrically displaceable slider and said rotatable latch is an inclined recess foreseen for facilitating the entrance of a projectile into the fire-arm barrel.

13. A safety device as set forth in claim 1, wherein said recess of the fire-arm barrel used for engagement of one of said diametrically displaceable slider and said rotatable latch is a recess defined by a rear frontal face of the fire-arm barrel.

* * * * *